US008449006B2

(12) United States Patent
Joerger et al.

(10) Patent No.: US 8,449,006 B2
(45) Date of Patent: May 28, 2013

(54) APPLIANCE ACCESS DOOR STRIKE ASSEMBLIES FOR ADDRESSING LATCH OPERATION ISSUES ARISING FROM DIMENSIONAL VARIANCES

(75) Inventors: Steven J. Joerger, Ames, IA (US); Chris H. Hill, Ames, IA (US); Jason Schott, Webster City, IA (US); Douglas C. Norman, Webster City, IA (US)

(73) Assignee: Electrolux Home Products, Inc., Charlotte, NC (US)

( * ) Notice: Subject to any disclaimer, the term of this patent is extended or adjusted under 35 U.S.C. 154(b) by 1302 days.

(21) Appl. No.: 12/184,061

(22) Filed: Jul. 31, 2008

(65) Prior Publication Data

US 2010/0026015 A1 Feb. 4, 2010

(51) Int. Cl.
*E05B 15/02* (2006.01)

(52) U.S. Cl.
USPC ..... 292/340; 292/341.15; 292/341.18

(58) Field of Classification Search
USPC ..... 292/340, 341, 341.15, 341.18, 341.19
See application file for complete search history.

(56) References Cited

U.S. PATENT DOCUMENTS

| | | | |
|---|---|---|---|
| 446,173 | A | 2/1891 | Hancock |
| 513,667 | A | 1/1894 | Buckingham |
| 872,053 | A | 11/1907 | Christy |
| 1,214,227 | A | 1/1917 | Schwenk |
| 1,676,515 | A | 7/1928 | Anstey |
| 1,888,829 | A | 11/1932 | Moore |
| 1,936,921 | A | 11/1933 | Strid |
| 2,211,963 | A | 8/1940 | Strid |
| 2,403,182 | A | 7/1946 | Leary et al. |
| 2,592,274 | A | 11/1949 | Groeger |
| 2,695,807 | A | 11/1954 | Bissot |
| 2,781,219 | A | 2/1957 | Bahorik |

(Continued)

FOREIGN PATENT DOCUMENTS

| | | |
|---|---|---|
| DE | 3919458 | 12/1990 |
| DE | 4317135 | 9/1994 |

(Continued)

*Primary Examiner* — Carlos Lugo
*Assistant Examiner* — Mark Williams
(74) *Attorney, Agent, or Firm* — Banner & Witcoff, Ltd.

(57) ABSTRACT

A technique and various door/latch structures are provided to deal efficiently and effectively with excessive appliance door closure/opening forces that can arise in the case that the door strike extension depth is not ideally matched to the relative location of the mating latch mechanism. This is particularly useful in connection with the use of a push-push style access door that must be compressed against a compressible seal gasket in order to effect both opening and closing of the door. A strike member is mounted to one of an appliance cabinet and door so as to be engagable with a latch mechanism when the door is in the closed position. The installing involves initially tentatively mounting the strike in a first of at least two provisioned ways, to thereby provide a first of at least two different strike extension depths. The door operation is then tested to determine whether an excessive operation force is required in order to open or close the door. Upon determining that an excessive operation force is required to open or close the door, the strike member is removed from its initial mount and remounted in a second of the at least two provisioned ways, to thereby provide a second of the at least two different strike extension depths. In another aspect, a limited amount of z-axis play of the strike is permitted to avoid inadvertent unlatching, e.g., of a push-push latch, upon a slam of the door shut.

19 Claims, 15 Drawing Sheets

U.S. PATENT DOCUMENTS

| | | | | |
|---|---|---|---|---|
| 2,833,578 | A | 5/1958 | Burke | |
| 3,454,295 | A | 7/1969 | Schlage et al. | |
| 3,603,631 | A * | 9/1971 | White | 292/220 |
| 3,713,681 | A | 1/1973 | Worley | |
| 3,912,311 | A | 10/1975 | Carvell et al. | |
| 4,171,836 | A | 10/1979 | St. Aubin | |
| 4,207,655 | A | 6/1980 | MacMaster | |
| 4,492,397 | A | 1/1985 | Allenbaugh | |
| 4,655,489 | A | 4/1987 | Bisbing | |
| 4,745,250 | A | 5/1988 | Mayo | |
| 4,764,648 | A | 8/1988 | Resh | |
| 5,118,151 | A | 6/1992 | Nicholas, Jr. et al. | |
| 5,243,771 | A * | 9/1993 | Kretchman et al. | 34/108 |
| 5,517,006 | A | 5/1996 | Fredriksson et al. | |
| 6,250,694 | B1 | 6/2001 | Weiland | |
| 6,257,632 | B1 | 7/2001 | Jung et al. | |
| 6,290,270 | B1 | 9/2001 | Spiessl | |
| 6,327,789 | B1 | 12/2001 | Malsom | |
| 6,340,182 | B1 | 1/2002 | Kaneda et al. | |
| 6,390,518 | B1 | 5/2002 | Elick | |
| 6,394,300 | B1 | 5/2002 | Bosy | |
| 6,454,320 | B1 | 9/2002 | Weinerman et al. | |
| 6,527,315 | B2 | 3/2003 | Marks et al. | |
| D474,673 | S | 5/2003 | Weinerman et al. | |
| 6,575,503 | B1 | 6/2003 | Johansson et al. | |
| 6,679,572 | B2 | 1/2004 | Sears | |
| 6,685,241 | B2 * | 2/2004 | Bollmann | 292/341.16 |
| 6,719,337 | B1 | 4/2004 | Ji | |
| 6,843,184 | B2 | 1/2005 | Wall et al. | |
| 6,954,992 | B2 * | 10/2005 | Hwang | 34/108 |
| 7,000,959 | B2 | 2/2006 | Sanders | |
| 7,210,711 | B2 | 5/2007 | Dirnberger et al. | |
| 7,240,931 | B1 | 7/2007 | Casey | |
| 7,360,810 | B2 * | 4/2008 | Dennis | 292/341.18 |
| 8,056,942 | B2 * | 11/2011 | Marini et al. | 292/80 |

FOREIGN PATENT DOCUMENTS

| | | |
|---|---|---|
| DE | 4424201 | 1/1996 |
| DE | 19540843 | 5/1997 |
| DE | 19636925 | 12/1998 |
| DE | 102007009539 | 7/2008 |
| DE | 102007009540 | 8/2008 |
| EP | 331643 | 9/1989 |
| EP | 0533635 | 3/1993 |
| EP | 654556 | 11/1994 |
| EP | 727178 | 8/1996 |
| FR | 1350994 | 12/1963 |
| FR | 2714106 | 12/2008 |

* cited by examiner

APPLIANCE ACCESS DOOR STRIKE ASSEMBLIES FOR ADDRESSING LATCH OPERATION ISSUES ARISING FROM DIMENSIONAL VARIANCES

BACKGROUND OF THE INVENTION

The present invention relates to appliance door latch constructions, and particularly to door latch strike assemblies suitable for use in the latching mechanism of an access door of a laundry appliance, e.g., an automated laundry washing machine.

Automated washing machines (such as laundry washing machines) typically include a door that swings open and shut to permit access to the wash basin or drum, for placement of wash load items in the drum at the initiation of the wash process and removal of the wash load items upon completion of a wash operation. Automated laundry dryers typically have a similar arrangement of door and access opening. Various types of latch assemblies are utilized to securely hold the door shut. This may include a safety interlock system to prevent opening of the door during certain operation cycles such as during a high-speed spin of a washer. Such door latch systems (whether with or without a safety interlock) typically include an elongate "strike" that protrudes from one of the door and the door receiving frame defining the access opening. The strike is configured to be engagingly received in a latch incorporated into the other one of the door and door receiving frame.

Consumers have certain expectations when it comes to the forces required to open and close laundry appliance access doors. Under the extreme tolerance stacks that come into play in the manufacture/assembly of a laundry appliance, dimensional variances within specified tolerances may add cumulatively causing dimensional variances in the alignment and relative positioning of the latch and the mating strike. In turn, this may lead to excessive forces being required for opening and/or closing the door, e.g., forces that are outside of desired marketing specifications. The situation is exacerbated in the case of an access door that is pressed shut against a compressible door bellow, seal gasket or the like provided in order to prevent leakage of liquid from the wash chamber (or heated air from a dryer). In this case, it is necessary that a certain amount of force be applied to press against the bellow or gasket sufficiently to obtain a fluid-tight seal. On the other hand, the closure force cannot be so high as to render it difficult for a user to manually effect the closure. A further difficulty is encountered in the case that it is desired to use a push to open, push to close (push-push) style door/latch in such an application. In this case, since the latch requires a relative inward (push) displacement of the strike from its normal closed door position, in order to open the door, the gasket will have to be further compressed, and if the strike extension depth is not correct to a fairly precise degree, operational difficulties are likely to be encountered. In particular, the further compression of the seal gasket necessary to move the strike sufficiently to actuate release of the push-push latch may require a user to exert more force than would be desirable. The amount of bellow/gasket compression required to effect latching (or unlatching), and hence the closure force required to secure the door shut (or open it), is directly impacted by the extension depth of the strike from the door. If the point that must be reached to latch or unlatch the door is significantly beyond a point where the door begins to compress the main front face of the bellow, this adds significant opposing forces with little inward movement of the door assembly. On the other hand, if there is excessive strike extension, the seal/bellow may not be adequately pressed by the door, resulting in an inadequate seal and leakage potential. There is no easy fix in the case that the force required to open/close the door is excessive due to insufficient strike extension, or if there is an inadequate seal/leakage potential due to excessive strike extension. Parts would need to be replaced or hand modified/adjusted to reach desired door forces.

Some previous attempts have been made to deal with misalignments that can arise between door strike and latch structures.

U.S. Pat. No. 6,685,241 discloses a closing device for a laundry appliance which includes a strike ("closing piston") mounted to the machine door with pins within horizontally aligned slots, to effect automatic strike/latch alignment upon door closure.

DE 19636925 discloses a locking element ("clamp (12)") of a washing machine lid that "is mounted on or in an underplate (8) of the lid in such a way it moves within limits across its closing direction." English Abstract.

U.S. Pat. Nos. 7,240,931 and 5,118,151 both disclose a slide mount of door strike elements (not an appliance door); the '931 patent discloses a strike plate horizontally slideable in channels located on a base plate.

U.S. Pat. No. 6,679,572 discloses a lid or door for a laundry appliance that employs a push-push latch and a gas-charged cylinder for extending the door to an open position upon release of the latch. This patent does not address the issue that can arise with an attempt to use a push-push actuated access door with a compressible seal gasket or bellow. While front load appliances are mentioned, the illustrated top load washer embodiment would inherently have much less need for a strong liquid-tight seal as compared to a front load washer.

There is a need for a technique and door/latch structure to deal efficiently and effectively with the excessive door closure forces and other potential complications that can arise in the case that the door strike extension depth is not ideally matched to the relative location of the mating latch mechanism. This would be particularly useful to render feasible and reliable the use of a push-push style access door that must be compressed against a compressible door bellow or seal gasket in order to effect both opening and closing of the door.

SUMMARY OF SELECTED INVENTIVE ASPECTS

In one aspect, the present invention provides an appliance, including a housing cabinet and an interior compartment defined within the housing cabinet. The housing cabinet defines an access opening to provide user access to the interior compartment, and has a door mounted to the cabinet so as to be moveable between an open position allowing the user access and a closed position extending over the access opening. A latch mechanism mounted to one of the housing cabinet and door. A strike member is mountable to the other one of the cabinet and door so as to be engagable with the latch mechanism when the door is in the closed position, to thereby releasably retain the door in the closed position. The strike member is provisioned for mounting in at least two ways providing, respectively, at least two different strike extension depths. The latch mechanism may be a push-to-open, push-to-close (push-push) mechanism that requires the door to compress a seal member in order to effect both latching and unlatching actuations of the mechanism.

In another aspect, the invention provides a method of assembling an access door latch set in an appliance including a housing cabinet defining an interior compartment and an access opening to provide user access to the interior compartment. A door is mounted to the cabinet so as to be moveable between an open position allowing user access and a closed position extending over the access opening. A latch mechanism is mounted to one of the housing cabinets and the door. A strike member is installed to the other one of the cabinet and door so as to be engagable with the latch mechanism when said door is in the closed position, to thereby releasably retain the door in the closed position. The installing includes the steps of initially tentatively mounting the strike in a first of at least two provisioned ways, to thereby provide a first of at least two different strike extension depths, testing the door operation and determining therefrom whether an excessive operation force is required in order to open or close the door, and upon determining that an excessive operation force is required to open or close the door, removing the strike member from its initial mount and remounting the strike in a second of the at least two provisioned ways, to thereby provide a second of the at least two different strike extension depths.

In one embodiment, the strike member includes a mounting platform that is mountable on a seat of the other one of the cabinet and door, in a first orientation and a second orientation. The first and second orientations provide, by virtue of a resulting interface of the mounting platform and the seat, the at least two different strike extension depths.

The strike may be mounted so as to provide a limited amount of play of the strike in a strike extension direction thereof, such as by means of a pin received in a slot of the strike. Such a feature can be effective to avoid inadvertent unlatching upon a slam of the door shut (such as may otherwise occur, e.g., with a push-push latch).

In another embodiment, the strike member is a two-headed strike that can be flipped end-for-end and mounted either way to select between two strike extension depths.

In yet another embodiment, a strike mounting plate with oppositely directed faces is provided. The plate, which may be generally c-shaped, selectively supports the strike member with one or the other of the two strike extension depths, depending upon which face of the plate is placed face-in/out.

The above and other objects, features and advantages of the present invention will be readily apparent and fully understood from the following detailed description of preferred embodiments, taken in connection with the appended drawings.

DETAILED DESCRIPTION OF EXEMPLARY EMBODIMENTS

Figure 1:
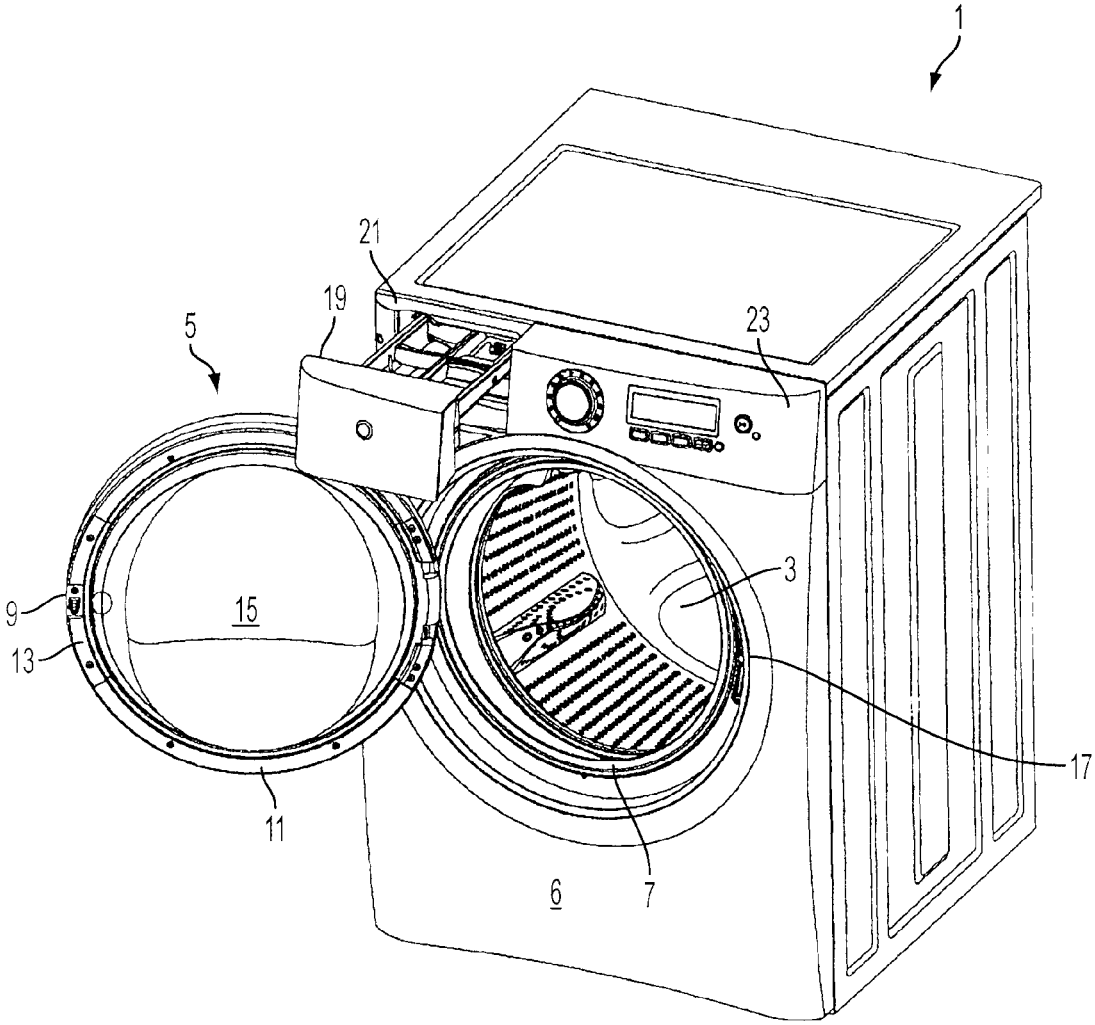
FIG. 1 is a front perspective view of a front load automatic laundry washer, with an access door thereof open to reveal a strike and latch set to which aspects of the invention may be applied.

Referring first to FIG. 1, illustrated is an exemplary laundry washing appliance (machine) 1 of the front-load, rotating drum variety. The washing machine includes a port-hole style access opening 3, and a door 5 hingedly mounted on a cabinet front panel or bulkhead 6 to swing between open and closed positions. It can also be seen in FIG. 1 that the washer 1 includes an assembly of a drawer 19 and a housing 21 having a cavity that receives the drawer alongside a control panel 23 of the appliance. The drawer 19 is extensible out of the housing to the position shown, to permit a user access to laundry additive retention compartments of the drawer.

Figure 2:
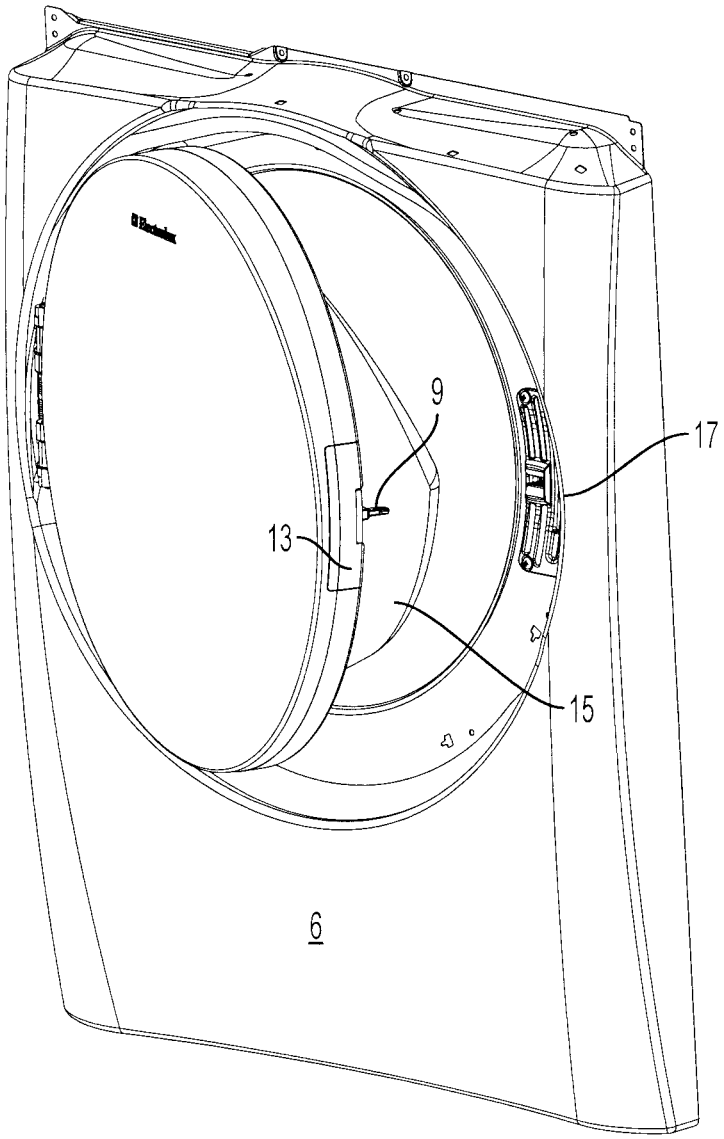
FIG. 2 is a frontal perspective view of front panel and door assembly of the washer shown in FIG. 1.
Figure 3:
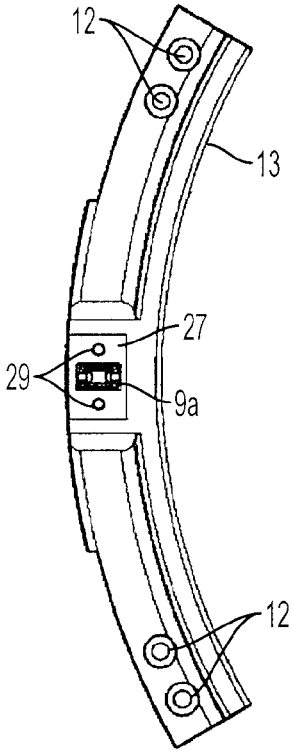
FIG. 3 is a front elevation view of a strike and door frame mounted strike carrier assembly in accordance with an aspect of the invention.
Figure 4:
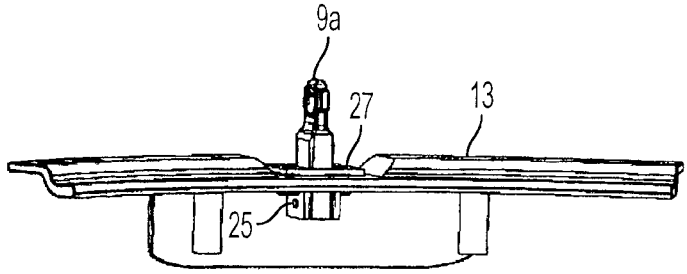
FIG. 4 is a side perspective view of the strike and door frame mounted strike carrier assembly shown in FIG. 3.

Surrounding the access opening 3 is a compressible door bellow 7 of rubber or the like that provides a water-tight flexible connecting passage extending between the access opening of the suspended wash group and the access opening of the cabinet front panel 6. Bellow 7 also serves to provide a liquid-tight seal with the door 5 when the door is closed and latched. With the door in the open position as shown in FIGS. 1 and 2, it can be seen that a door strike 9 is mounted on and protruding inwardly from an inner frame 11 of the door. In the embodiment shown, the strike is mounted on a carrier structure 13 which is, in turn, mountable to the door frame. In this particular embodiment, carrier 13 forms an arcuate segment of the inner door frame 11. This carrier structure is referred to hereinbelow as a door frame mountable strike carrier. As illustrated, it is an arcuate structure which, when installed, with screws or other fasteners passing through holes 12, completes a circle that is formed by an inner frame of the door. In one embodiment, the inner frame has a construction as described in commonly owned copending application Ser. No. 11/944,032, filed Nov. 21, 2007. In the case of a washer (as illustrated), this inner frame surrounds an inwardly directed port-hole plug structure 15, which may be formed of molded transparent plastic or glass. Plug structure 15 serves to protect the bellow from tumbling load items and to redirect clothes back toward the cavity of the drum as they are tumbled.

The strike 9 interacts with a latch 17 in order to securely hold the door in its closed position. As best seen in FIG. 2, the latch 17 is, in this embodiment, installed within the frame or housing structure of front cabinet panel 6 surrounding the circular access opening 3. The latch may be of a conventional construction and may include a safety interlock for preventing the door from being opened during certain operation cycles, such as high-speed washer spin cycles. In one embodiment, the latch 17 is a push-push style latch that both opens (unlatches) and closes (latches) with the press of the door. Such latches, which are of well know construction, require inward displacement of the strike relative to the latch structure in order to actuate both latching and unlatching. Rather than making the strike part of a push-button mechanism moveable independently of the door, in the illustrated embodiment, the strike is fixedly mounted to extend inwardly from the inside surface of the door frame 11. As such, in effect, the entire access door 5 acts as a very large push-button. A closure of the door (a first push) effects a latching of the door, i.e., the strike is trapped within the latching mechanism. A second inward push on the closed door effects an unlatching operation. This unlatching operation depends for its proper operation on the ability of the door 5 (and strike 9 attached thereto) to move inwardly, from a closed sealed position of the door, a distance sufficient to actuate the push-push latch to unlatch. This will require the seal gasket 7 to compress an additional amount from the already compressed state that it assumes in the closed position of the door. The door mounted strike 9 must extend to an appropriate depth or the force required to actuate the push-push latch mechanism will be excessive. A small deviation, e.g., of 1 mm, in strike depth can have a significant impact on the force required to open and close the door. And, it is difficult to maintain such close control in the final assembled product. Without an effective way to deal with this issue, it could prove impractical to provide a front-load laundry appliance with this type of push-push actuation.

Referring to FIGS. 3-8*b*, a first embodiment of the invention is illustrated, wherein a strike mounting bracket 27 can be mounted on the door frame mountable strike carrier 13 in one of the two orientations rotated 180 degrees with respect to each other, to obtain adjustment of the strike extension depth. In addition, a lateral (horizontal) pivotal movement of a strike 9*a* is permitted by a mount of the strike on a pivot pin 25, and the clearance of a receiving hole in strike mounting bracket 27.

Figure 8A:
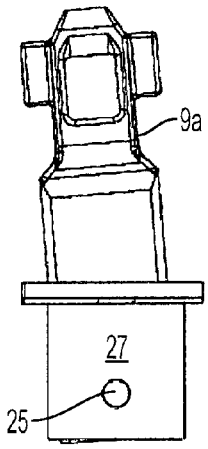
FIG. 8*a* is a side elevation view of the strike sub-assembly shown in FIG. 7, illustrating a first pivot position of the strike.
Figure 8B:
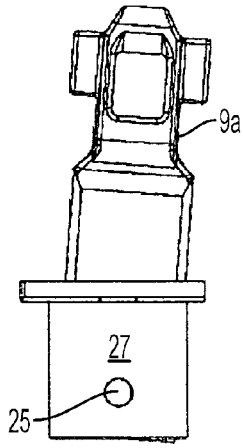
FIG. 8*b* is a side elevation view of the strike sub-assembly shown in FIG. 7, illustrating a second pivot position of the strike.
Figure 9:
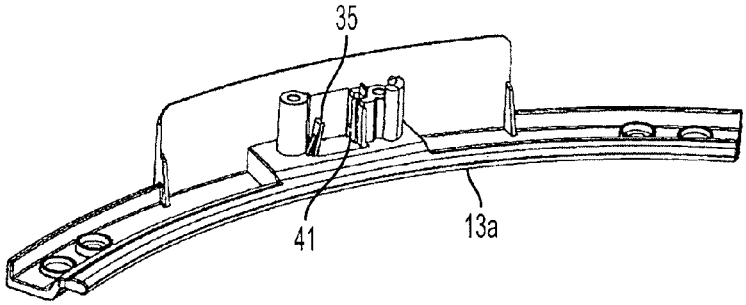
FIG. 9 is a side perspective view of a door frame mountable strike carrier in accordance with a second embodiment of invention.
Figure 10:
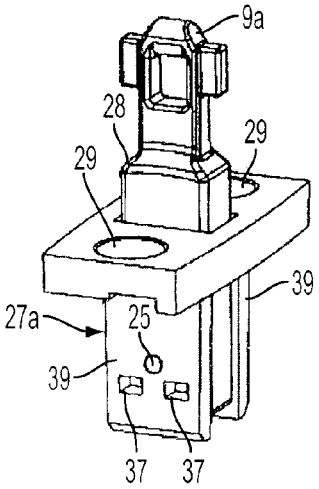
FIG. 10 is a perspective view of a strike sub-assembly of the second embodiment, the sub-assembly including an elongated strike member and a snap-in snap-out mounting bracket for pivotally mounting the strike to the strike carrier of FIG. 9, in one of two positions providing first and second strike extension depths.
Figure 11:
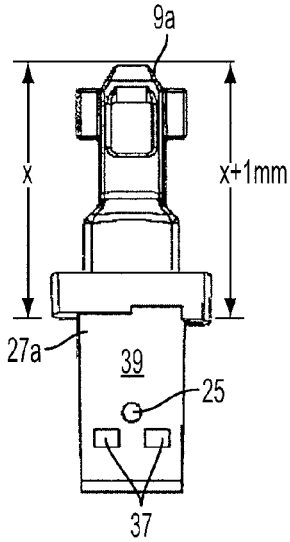
FIG. 11 is a side elevation view of the strike sub-assembly shown in FIG. 10.

The attachment of strike 9*a* to a pivot pin 21 allows it to rock laterally (horizontally) a small amount, e.g., 3 mm total x-axis displacement, in order to allow the strike to find the best locking position in the latch as the door is closed. FIGS. 8*a* and 8*b* illustrate the strike 9*a* at the opposite ends of its pivotal swing. The strike assembly, comprising the strike 9*a* and its mounting bracket 27, is installed in a through-hole provided in the door frame mountable strike carrier 13. It may be secured in its mount with screws or other fasteners passing through holes 29.

Figure 5A:
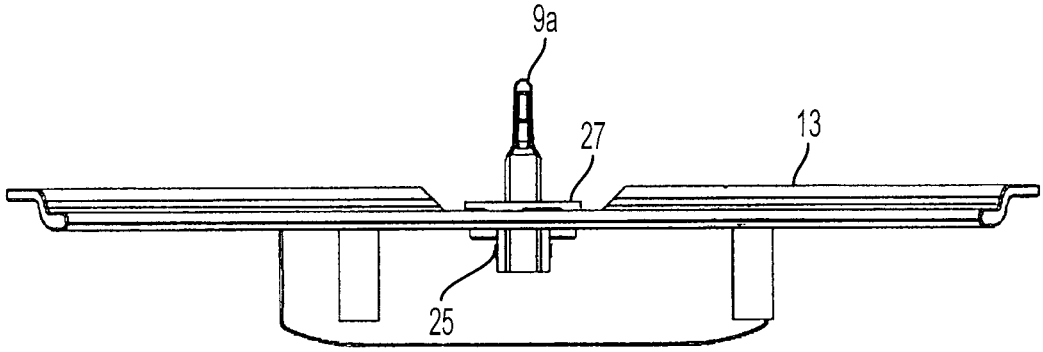
FIG. 5*a* is a side elevation view of the strike and door frame mountable strike carrier assembly of FIG. 3, with the strike mounted in a first position providing a first extension depth of the strike.
Figure 5B:
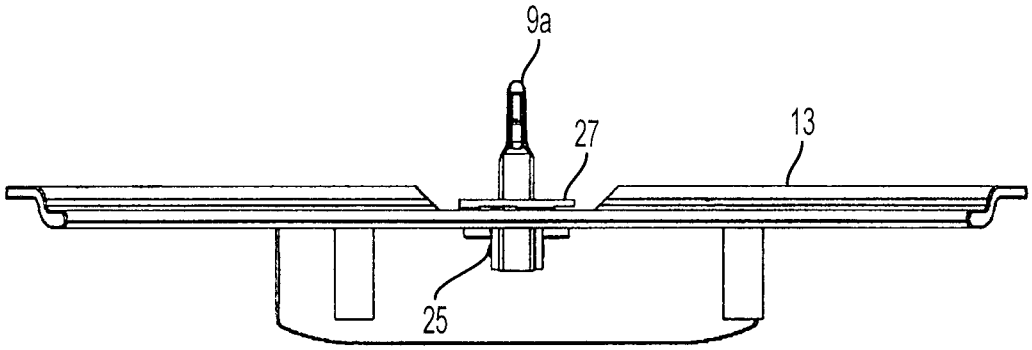
FIG. 5*b* is a side elevation view of the strike and door frame mountable strike carrier assembly of FIG. 3, with the strike mounted in a second position providing a second extension depth of the strike.

To address a potential mis-match of latch and strike extension depth, both the strike carrier 13 and strike assembly mounting bracket 27 have mounting platform surfaces provided with surface profiles which, when installed in one direction (illustrated in FIG. 5*a*), will interlock or nest to locate the strike on the door with a first or standard strike depth extension. If the door closing forces are too high, the screws may be removed from holes 29 and the strike mounting bracket may be turned 180 degrees. The mounting bracket may then be reinstalled (as shown in FIG. 5*b*) with the mounting bracket platform riding higher, i.e., in a position offset outwardly with respect to the first position. The offset amount is determined by the interface between the mounting platform of the mounting bracket and the mounting platform or seat of the door mountable strike carrier 113. In one embodiment, the rise and recess dimensions of the mating platform surfaces provide a strike extension depth differential of 1 mm between the two positions. In this manner, a strike extension depth adjustment can be made without the need to disassemble the door, either at the time of assembly or by the user after installation, if necessary.

Figure 6:
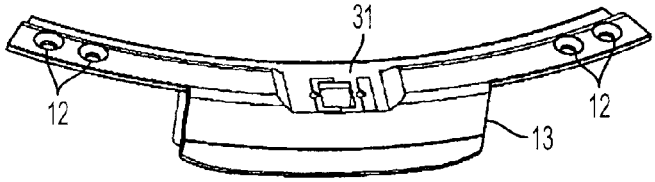
FIG. 6 is a front perspective view of the door frame mountable strike carrier shown in FIGS. 3-5*b*, with the strike removed to reveal a multi-positional strike mounting platform.
Figure 7:
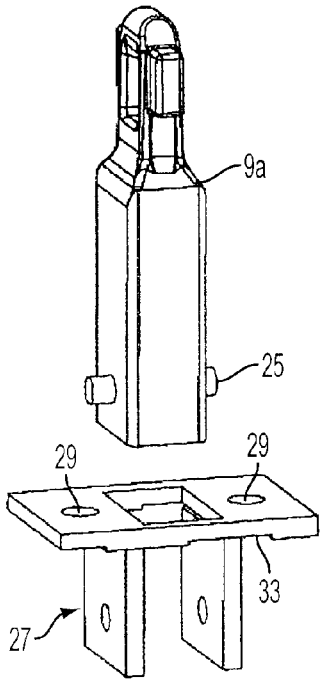
FIG. 7 is a perspective assembly view of a strike sub-assembly of the assembly shown in FIGS. 3-5*b*, the sub-assembly including an elongated strike member and a mounting bracket for pivotally mounting the strike to the strike carrier assembly.

The interfacing strike carrier platform surface or seat 31 and mounting bracket platform surface 33 are illustrated more clearly in FIGS. 6 and 7, respectively. Various patterns of rises and recesses may be used to provide a stable mount of the strike mounting bracket in alternative positions providing at least two different strike extension depths.

FIGS. 9-14 illustrate a second embodiment constituting a modified version of the previous embodiment, wherein a snap-in arrangement of a strike mounting bracket 27*a* is provided to facilitate a quick mount of the strike in the first instance, and to allow a quick change of the mount if necessary in order to compensate for dimensional variances leading to excessive door opening/closing forces. A typical assembly process according to the invention is as follows. The modified strike mounting bracket 27*a* is inserted into a modified door frame mountable strike carrier 13*a* in a first or standard position so as to provide a strike of the standard extension depth. In general, a light spring action biases the strike mounting bracket 27*a* into locking engagement with the strike carrier 13*a* as it is inserted. This locking engagement is readily released by a slight lateral (e.g., upward or downward) manual press against the spring bias to laterally displace the strike assembly slightly within the cavity of the strike carrier that accepts the strike assembly. In the illustrated embodiment, a spring arm 35 is provided on the strike carrier 13*a* along the strike mounting bracket reception cavity provided in carrier 13*a*, in the path of movement of the strike assembly as it is inserted. Strike mounting bracket 27*a* has a pair of holes 37 on each of the arms 39 that flank and retain the strike 9*a*. These holes are positioned such that as the strike mounting bracket 27*a* is inserted into the strike carrier 13*a*, the holes 37 come into mating engagement with a pair of mating protrusions or teeth 40 provided on the side 41 of the cavity opposite the spring arm 35. The spring arm 35 gently urges the strike mounting bracket 27*a* laterally (vertically in the installed state of the strike carrier) during the insertion such that these elements are brought into snap-fit engagement with each other, whereby the strike assembly is releasably retained in the carrier 13*a*.

Figure 12:
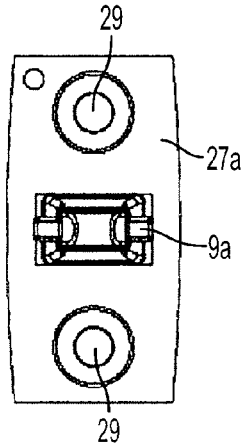
FIG. 12 is a top plan view of the strike sub-assembly shown in FIG. 10.
Figure 9A:
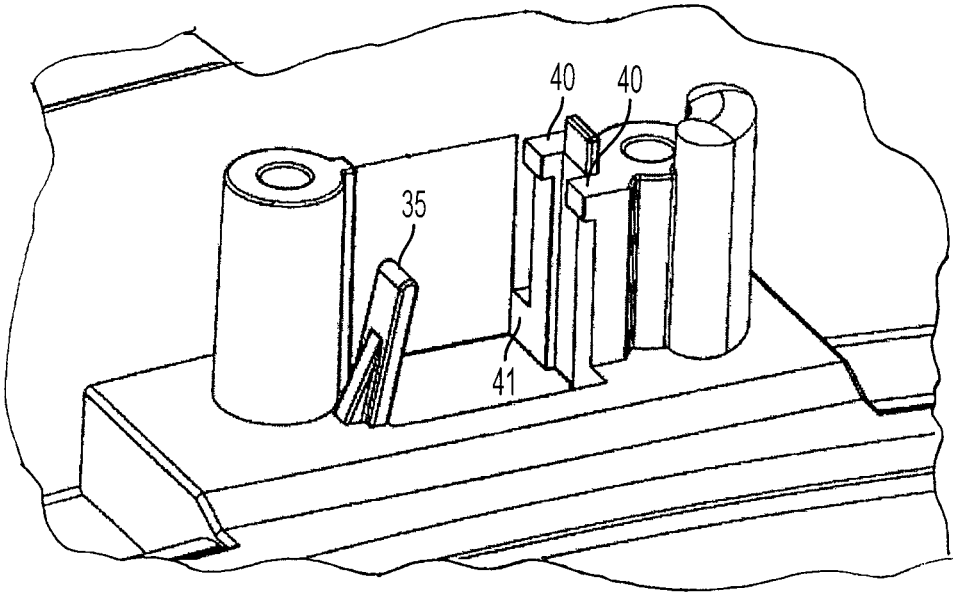
FIG. 9*a* is a close-up perspective view of a portion of the strike carrier shown in FIG. 9.
Figure 13:
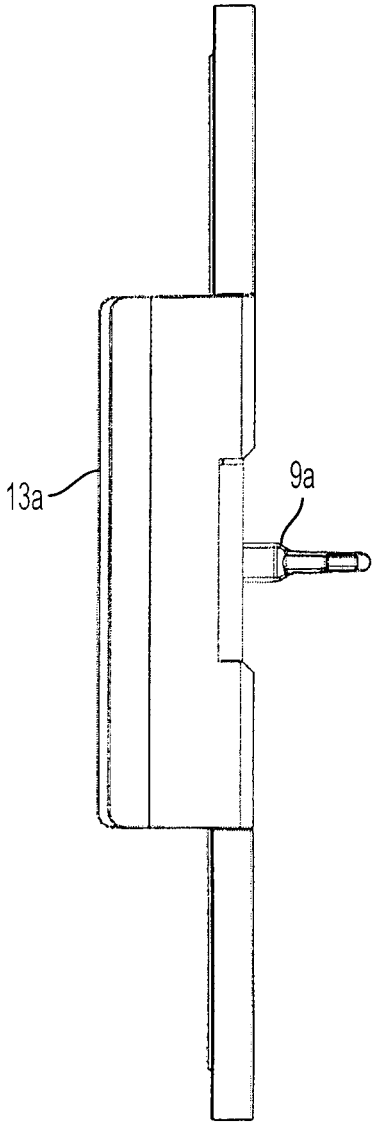
FIG. 13 is a side elevation view of an assembly of the strike sub-assembly of FIG. 10 and the door frame mountable strike carrier of FIG. 9.
Figure 14:
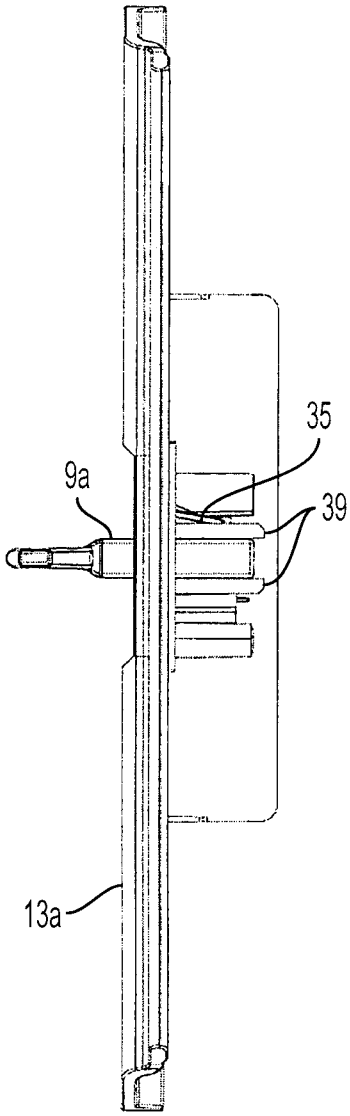
FIG. 14 is an opposite side elevation view of the assembly shown in FIG. 13.
Figure 16B:
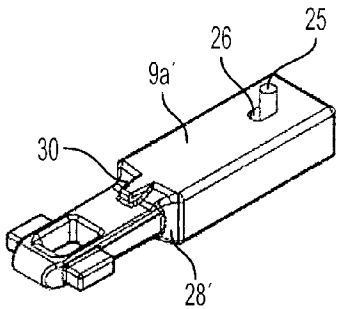
FIG. 16*b* is a perspective view of the strike of the strike sub-assembly shown in FIG. 15, with a mounting pin thereof shown positioned at the rear of a mounting slot of the strike.
Figure 16A:
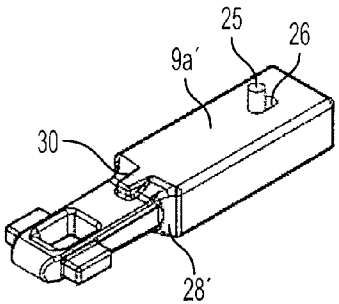
FIG. 16*a* is a perspective view of the strike of the strike sub-assembly shown in FIG. 15, with a mounting pin thereof shown positioned at the front of a mounting slot of the strike.
Figure 15:
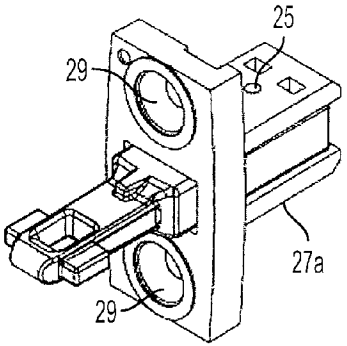
FIG. 15 is a perspective view of a strike sub-assembly according to a third embodiment of the invention.
Figure 17B:
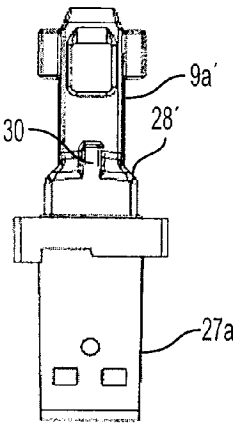
FIG. 17*b* is a side elevation view of the strike sub-assembly of FIG. 15, in a second position with the pivotal mounting pin positioned at the rear of the mounting slot of the strike.
Figure 17A:
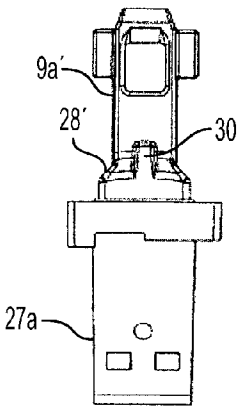
FIG. 17*a* is a side elevation view of the strike sub-assembly of FIG. 15, in a first position with the pivotal mounting pin positioned at the front of the mounting slot of the strike.
Figure 18:
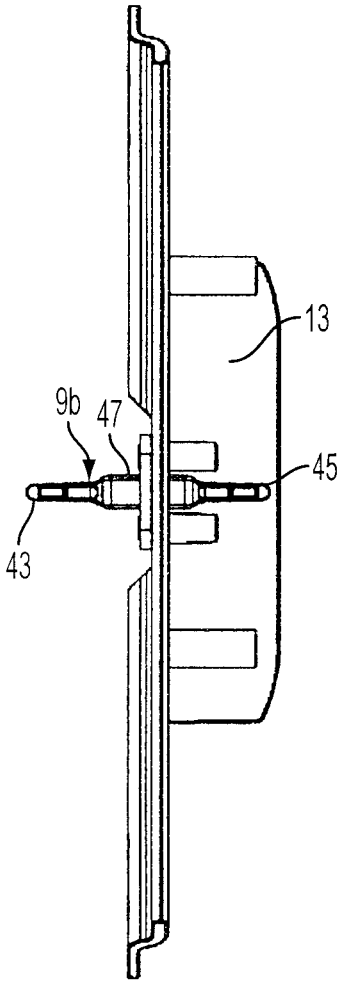
FIG. 18 is a side elevation view of a strike and door frame mountable strike carrier assembly according to a fourth embodiment of the invention.
Figure 19:
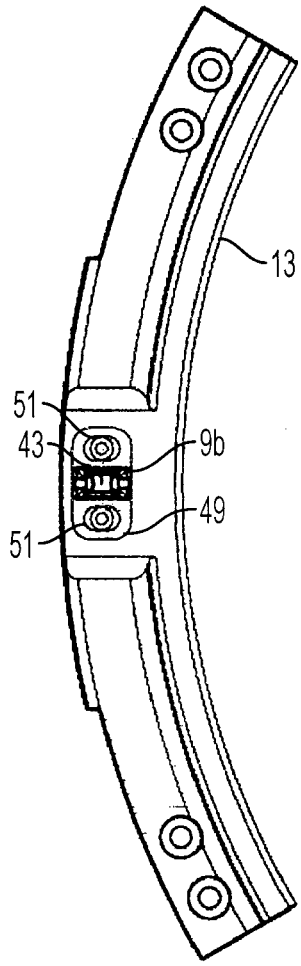
FIG. 19 is a front elevation view of the front panel and door assembly of the washer shown in FIG. 18.
Figure 20:
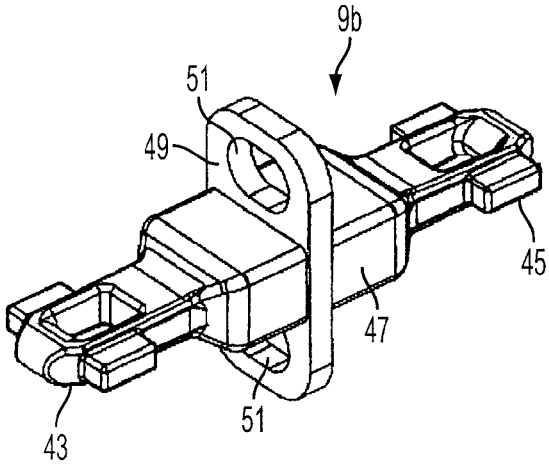
FIG. 20 is a perspective view of the two-headed strike of the assembly shown in FIG. 18.
Figure 21:
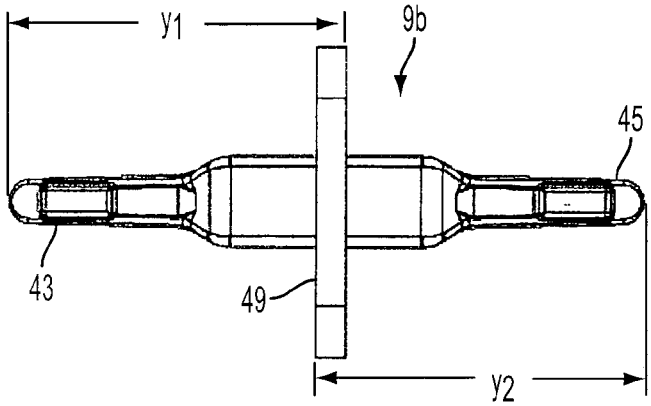
FIG. 21 is a side elevation view of the two-headed strike of the assembly shown in FIG. 18.
Figure 22:
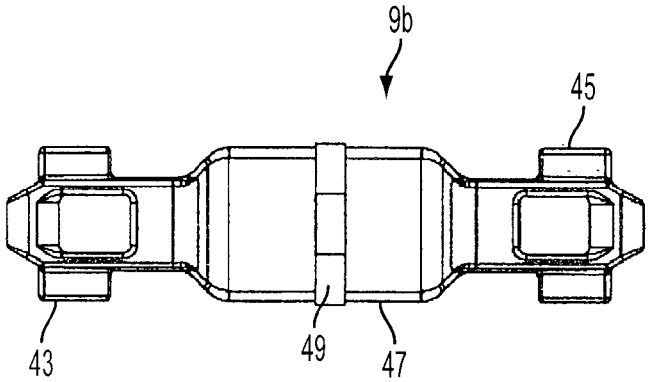
FIG. 22 is a top plan view of the two-headed strike of the assembly shown in FIG. 18.
Figure 23A:
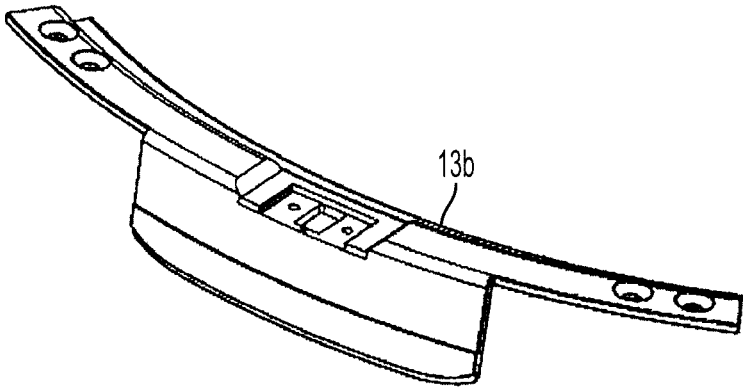
FIG. 23*a* is a side perspective view of a door frame mountable strike carrier in accordance with a fifth embodiment the invention.
Figure 23B:
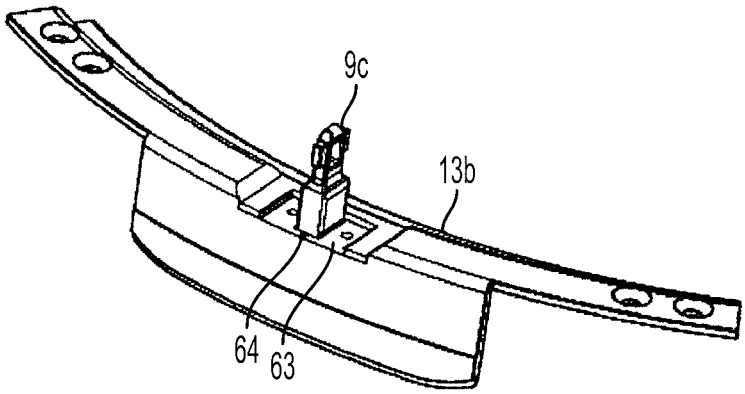
FIG. 23*b* is a side perspective view of the door frame mountable strike carrier of FIG. 23*a*, with a strike of the fifth embodiment positioned thereon.
Figure 23C:
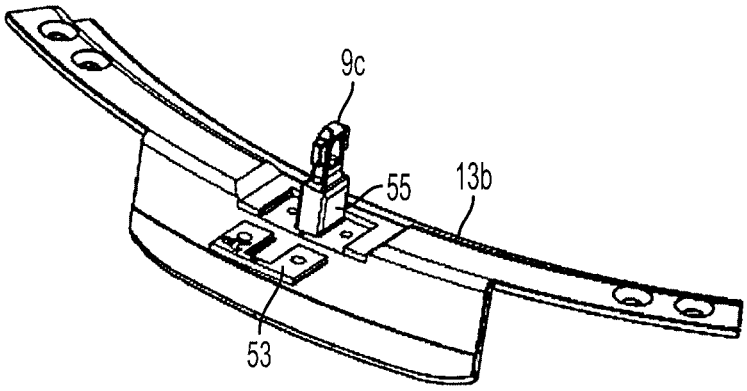
FIG. 23*c* is a side perspective assembly view of the door frame mountable strike carrier and strike of FIG. 23*b*, and further showing a reversible C-shaped strike extension depth adjustment plate of the fifth embodiment.
Figure 23D:
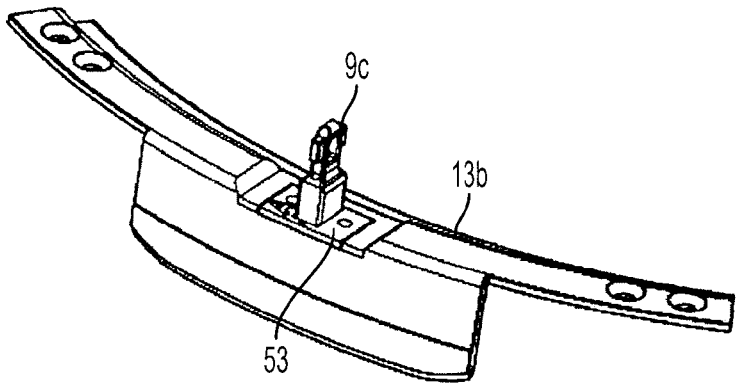
FIG. 23*d* is a side perspective view of the door frame mountable strike carrier, strike and reversible C-shaped strike extension depth adjustment plate of FIG. 23*c*, with the plate installed A-side up to provide one of two possible extension depths.
Figure 23E:
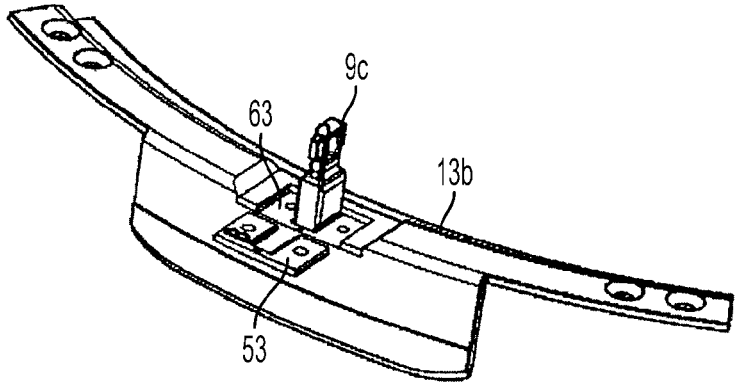
FIG. 23*e* is a side perspective assembly view of the door frame mountable strike carrier, strike and reversible C-shaped strike extension depth adjustment plate of FIG. 23*c*, with the plate oriented B-side up to provide, upon installation, a second one of the two possible extension depths.
Figure 23F:
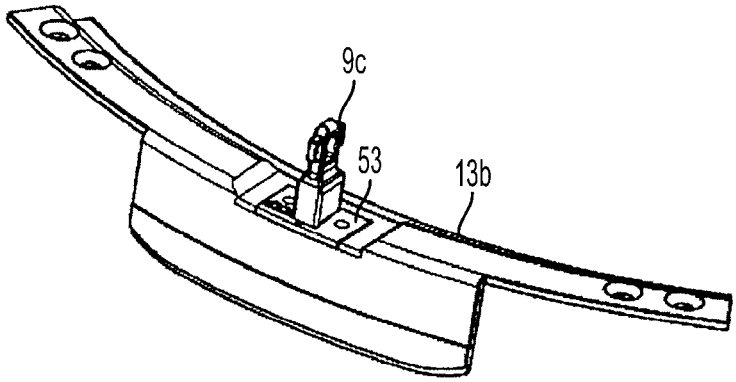
FIG. 23*f* is a side perspective view of the door frame mountable strike carrier, strike and reversible C-shaped strike extension depth adjustment plate of FIG. 23*c*, with the plate installed B-side up to provide the second one of the two possible extension depths.

With strike mounting bracket 27*a* installed in the carrier 13*a*, and the carrier 13*a* mounted to (and, in the exemplary embodiment forming a portion of) inner door frame 11, an opening and closing force test can be performed (e.g., a quantitative closure force measurement undertaken with a force gauge, and the strike assembly insertion position can be easily changed, if necessary, without installing/removing any screws. More particularly, if the door closure or opening forces are high, the operator can slightly shift the strike assembly laterally (e.g., vertically in the installation condition) to thereby release the teeth 40 from the holes 37, and then the strike mounting bracket 27*a* may be pulled out of the cavity, rotated 180 degrees and reinserted to snap-back in place with engagement of the teeth 40 with the pair of holes 37 provided on the opposite flanking arm 39. As with the first embodiment, such a reversal can be used to provide a relatively slight adjustment, e.g., 1 mm, in the extension depth of the strike, to thereby bring the door opening/closing forces into specification. Upon determination of the best of the two strike depths, retaining screws may be installed in the mounting holes 29. In this manner, a strike exterior depth adjustment can be made without the need to disassemble the door assembly, and without installing retaining screws until the final adjustment is obtained. As shown in FIG. 12, a mark or indicia may be provided at a corner or side of the strike mounting bracket in order to clearly indicate the strike depth determining orientation of the strike mounting bracket 27*a* with respect to the door frame mountable strike carrier 13*a*.

FIGS. 15-17*b* illustrate a third embodiment constituting a modified version of the second embodiment (FIGS. 9-14). All of the features described above with respect to the second embodiment also apply to the third embodiment. Like features are labeled with like reference numbers. The third embodiment includes an additional feature which affords the strike some play in the depth (z-axis) direction. In particular, in lieu of a simple circular through-hole in the strike body 9*a* to receive pin 25, a slot 26 with elongation along the longitudinal axis of the strike is provided. By this means, strike 9*a*' is permitted to move freely in the z-direction within a limited range, relative to the strike mounting bracket. The strike 9*a*' is shown with the mounting pin 26 at the forward limit of the permitted z-axis movement in FIGS. 16*a* and 17*a*, and at the rearward limit in FIGS. 16*b* and 17*b*. This provides benefit as follows.

In use, a user may forcefully swing (i.e., "slam") the door shut without maintaining pressing contact against the door at the time of latch contact. In this case, the door may shudder upon latch contact, i.e., create a second impulse that acts to inadvertently unlatch the door immediately after it has latched. This creates a nuisance for the user. This problem can arise especially in the case that a push-push latching mechanism is utilized. The z-axis play provided by the third embodiment of FIGS. 15-17*b* addresses this issue, by at least partially isolating any shudder of the door so that it is not transmitted, full-force, to the latch mechanism. The shudder movement and forces are at least partially absorbed by the z-axis movement of the strike 9*a*' relative to the door permitted by the slot 26.

In one embodiment, employing a pin 25 having a diameter of 2.5 mm, a slot length of 4.8 mm is provided. This provides 2.3 mm allowable z-axis movement. The slot may be so positioned to provide, in relation to the fixed location of the pin when placed in the circular hole of the previous (second) embodiment, 1.3 mm movement of the strike (and slot) back on the pin upon closure and latch contact. This results in some reduction in the effective strike extension depth and thus some increase in the latching/unlatching forces (see, e.g., positions shown in FIGS. 16*a* and 17*a*). The slot provides 1 mm of forward movement of the strike (and slot) upon a user's release of the closed door and under the outward pressing force of the door bellow, thus increasing slightly the strike extension depth and reducing somewhat the compressive door sealing forces. With a reasonable/acceptable cost in terms of increased latching/unlatching forces, and slightly reduced door sealing forces, the z-axis slot feature of the third embodiment can reduce if not eliminate the potential for the door to unlatch itself upon being slammed shut. Also, in the same manner as previously described, the strike 9*a*' may be mounted in the one of the at least two provisioned ways which provides the lowest door closure/opening (latching/unlatching) forces, e.g., by switching the mounting orientation of strike mounting bracket 27*a*. When latching/unlatching, the strike will be sitting at the rearward (reduced extension depth) position on the pin 26, so the ability to alter the reduced strike extension depth, e.g., by 1 mm, remains beneficial.

A further design modification of the third embodiment, in relation to the second embodiment, can compensate for the slightly increased latching/unlatching forces resulting from substitution of slot 26 for the circular pin mounting hole. In the second embodiment of FIGS. 9-14, the strike 9*a* is formed with a shoulder 28 tapering or necking down to a smaller head portion of the strike (see FIG. 10). The surfaces of the shoulder provide a centering lead-in to the mouth of the latch. In the event of door sag, the bottom one of the shoulder surfaces will contact with the mouth of the latch and the strike will ramp-up into proper vertical alignment with the latch mechanism. However, this requires that the hinged door rise up a commensurate amount. While generally slight, it was found that this need to slightly lift the door could significantly increase the required latching/unlatching forces. In the third embodiment of FIGS. 15-17*b*, the shoulder 28' is moved back (the length of the reduced section head portion is increased) sufficiently that it will not interact as a cam surface with the mouth of the latch upon closure. A stop structure (e.g., nib or post) 30 is provided. This stop structure can abut with the mouth of the latch in order to limit any slamming forces from being transmitted to the operative latch mechanism. As a result of the reduced impact forces on the latch mechanism upon slamming of the door, there is a reduced tendency for those forces to unlatch the latch (especially a push-push latch). Thus, additional assurance against unintended door slam-induced unlatching can be obtained. The lead-in provided by the other strike features, e.g., wobble and tapered leading nose, should generally be sufficient to deal with slight lateral and vertical misalignments (without the shoulder acting as a lead-in cam surface).

With the strike according to a fourth embodiment of the invention (FIGS. 18-22), the door opening and closing forces can be brought into specification, or otherwise improved, by permitting a depth extension adjustment of the strike (z-axis), and also lateral (x-axis) adjustability during door closure.

The strike 9*b* is a two-headed strike. Essentially, two strike heads 43, 45 are provided in longitudinal axial alignment with each other on the ends of respective strike shafts extending in opposite directions from a common central mounting base structure 47. Common base structure 47 may be integrally formed as a die cast part with the two strike heads and a mounting plate 49, or these parts could be formed separately and assembled/joined. One of the two strikes is longer than the other by a short distance, e.g., 1 mm, measured from the opposite mounting surface of mounting plate 49, that would support the strike in the operative position. In one example, one strike head 43 measures 33.7 mm in length from its associated mounting base surface that will interface with the mounting seat on the strike carrier (dimension $y_1$ in FIG. 21), and the oppositely directed strike head is positioned 32.7 mm from the opposite surface of mounting plate 49 that will interface with the seat when the shorter strike is placed in the operative position (dimension $y_2$ in FIG. 21). If the closing forces are too high with the shorter strike (e.g., strike 45) providing the standard strike extension depth, the strike 9*b* can be removed from its mount and flipped, end-for-end, to place the longer strike head 43 in the operative position. In the illustrated embodiment, this is accomplished by removing two mounting screws from associated slots 51 provided in mounting plate 49, to release the strike from its mount, and reinstalling the screws to secure the strike in its new position.

The provision of elongated slots 51 in strike mounting plate 49, in place of circular screw hole openings, allows the strike to slide horizontally (in the x-axis). This will permit the strike to find the best latching position within a range of variation, e.g., 3 mm as the door is closed. Screw bosses may be used to ensure that the tightening of the screw heads will not inhibit free sliding of the strike as it comes into engagement with the latch.

In the fifth embodiment of FIGS. 23*a*-28*b*, a strike 9 is allowed to slide and wobble to a limited extent in the x-axis, thus allowing the strike to find the best latching position in the latch/lock. Strike 9*c* is installed in an opening provided in an accurate door frame mountable strike carrier 13*b*, in the general manner of the previous embodiments. However, in this case, the strike 9*c* is secured by a separate plate 53 having the general shape of a C, which slides laterally onto a slotted base portion 55 of the strike, with the two arms of the C on opposite sides of the strike.

The oppositely directed faces of plate 53 bear visible indicia (A and B, as shown) to distinguish the faces from each other. Depending on which face of the C-plate faces up (A or B), one of two possible strike extension depths will be provided, which may differ from each other a relatively small amount, e.g., 1 mm. Thus, by selection of the installation position of the C-plate 53, the strike extension depth may be adjusted to reduce the forces required to open and close the door. In addition, the provision of a mount which allows the strike to wobble and slide within a small range compensates for any lateral (x-axis) misalignment.

Figure 25:
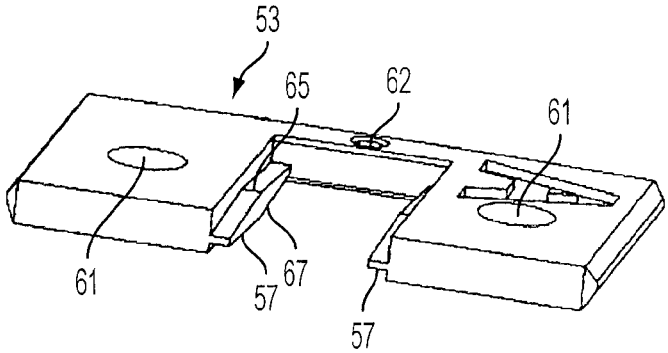
FIG. 25 is a perspective view of the extension depth adjustment plate of the fifth embodiment, A-side up.
Figure 26:
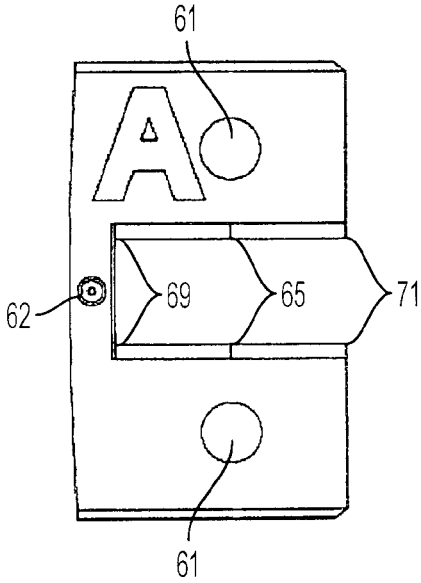
FIG. 26 is a top plan view of the extension depth adjustment plate of the fifth embodiment, A-side up.
Figure 27:
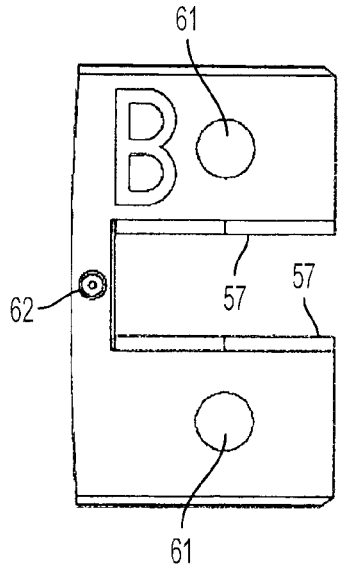
FIG. 27 is a top plan view of the extension depth adjustment plate of the fifth embodiment, B-side up.

In particular, and as best seen in FIGS. 25 and 26, the C-plate 53 has a two sided ramped rib 57 running along each inner side of the gap or void that receives the strike body between the arms of the C-plate. As will be explained, these ramped ribs 57 allow both strike extension depth adjustment, and a limited degree of strike wobble and slide from side-to-side.

Figure 24:
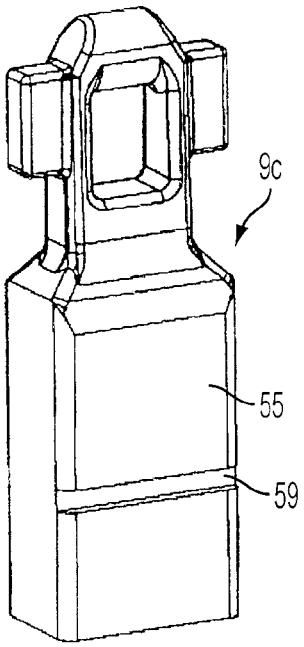
FIG. 24 is a perspective view of the strike of the fifth embodiment.

Ramped ribs 57 are slideably received within slots or grooves 59 extending across the width of opposite sides of strike 9*c*, as best seen in FIG. 24. During assembly of the washer, e.g., on an assembly line, the retaining screws that will pass through the holes 61 in plate 53 to secure the strike/plate assembly to the carrier 13*b*, will be left out until the door forces have been tested with the C-plate 53 installed in the standard position (e.g., A-side up—FIGS. 23*c* and 23*d*). A mating detent arrangement may be provided to hold the C-plate temporarily in place. This could comprise, e.g., a hole or recess 62 provided in C-plate 53, which is a friction-fit over a small nub 64 or the like provided on the recessed mounting seat 63 of carrier 13*b* (see, e.g., FIG. 23*b*). If the forces are too high, the C-plate will be removed, turned over and reinstalled (e.g., B-side up—FIGS. 23*e* and 23*f*), to thus increase the extension depth of the strike. The resultant increase (e.g., 1 mm) is equal to the difference in the offset of each oppositely facing rib surface from the surface (A or B) that will serve as the supporting interface with the mounting seat 63.

Figure 28A:
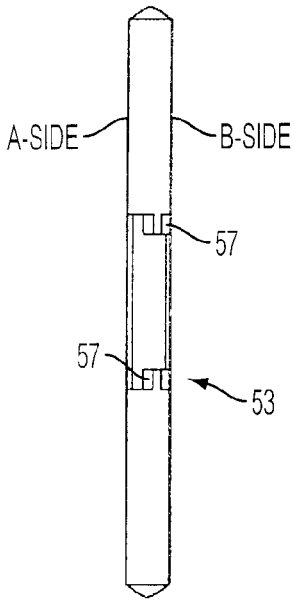
FIG. 28*a* is a side elevation view of the extension depth adjustment plate in a first orientation, positioning the extension depth determining mounting platforms thereof closest to the right side (greater recess on left side).
Figure 28B:
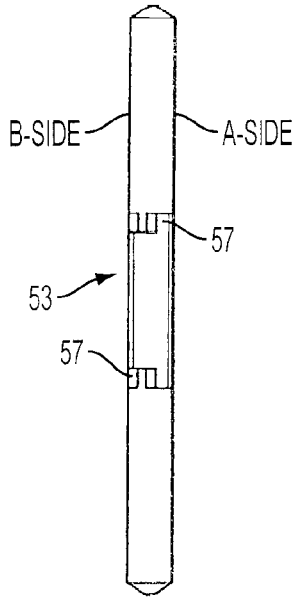
FIG. 28*b* is a side elevation view of the extension depth adjustment plate in a second (reversed) orientation, positioning the extension depth determining mounting platforms thereof closest to the left side (greater recess on right side).

The just-referenced offset of the ribs is plainly visible in FIGS. 28*a* and 28*b*, showing the plate in reversed orientations. The ribs thus serve to support the strike 9*c* at one of two possible levels. In the illustrated embodiment, the ribs 57 have, in profile, a shallow diamond shape, as seen in FIG. 25. Thus, on both ribs, the top and bottom surfaces diverge to central opposed apices 65, 67, and converge toward the opposite ends 69, 71 (see FIGS. 25 and 26). Such a ramp configuration allows the strike to wobble, i.e., pivot slightly, freely in a lateral horizontal (x-axis) direction, to thus permit the strike to "find" the best latching position as the door is closed. Allowable tolerances in the up-down direction (y-axis) are a bit more relaxed and slight misalignment in this axis can generally be dealt with by a design of the striker head with tapered lead-in surfaces serving to reduce impact force.

Once the most appropriate installation orientation of the C-plate is determined, screws may be passed through holes 61 to secure the assembly to the door frame mountable carrier 13*b* (which typically would already be mounted to form part of the door frame). In this manner, strike adjustment can be made without the need to replace or modify parts.

The general C-shape of the plate 53 is just one of may possible configurations. More generally, the plate is a plate with a void which accepts insertion of the strike from an open side thereof. A strike support structure is provided in the form of a pair of ribs extending along opposite sides of the void for engaging the strike and supporting the same with one or the other of two available strike extension depths, depending upon which face of the plate is placed face-in/out.

The strike member may be mounted on the strike mounting plate to extend in the facing direction of one of the two oppositely directed faces (e.g., side A), in which case the other side (e.g., side B) would face inward. The plate would then be mounted to the door frame mountable strike carrier (which would typically, but not necessarily, already be mounted to form a part of the door frame assembly). If testing showed that the open/closed forces of the door were excessive, the strike member would be removed and remounted so as to be supported on the strike mounting plate to extend in the facing direction of the second face (e.g., side B), with the first face (e.g., side A) being placed face-in, to thereby provide the second, greater strike extension depth. Obviously, the order of installation could be reversed, such that the installation providing the greater strike extension depth is tried first.

The present invention has been described in terms of preferred and exemplary embodiments thereof. Numerous other embodiments, modifications and variations within the scope and spirit of the appended claims will occur to persons of ordinary skill in the art from a review of this disclosure.

The invention claimed is:

1. An appliance, comprising:

a housing cabinet and an interior compartment defined within said housing cabinet, said housing cabinet defining an access opening to provide user access to said interior compartment;

a door mounted to said cabinet so as to be moveable between an open position allowing said user access and a closed position extending over said access opening;

a latch mechanism mounted to one of said housing cabinet and door;

a strike carrier mounted to the other one of said cabinet and door; and a strike member mountable to the other one of said cabinet and door via said strike carrier so as to be engagable with said latch mechanism when said door is in the closed position, to thereby releasably retain the door in the closed position, said strike member being provisioned for removable mounting on said strike carrier in at least a first position providing a first strike extension depth and a second position providing a second strike extension depth different than the first, said strike member being removable from and replaceable on said strike carrier in said first and second positions without removal of the strike carrier from said other one of the cabinet and door.

2. An appliance according to claim 1, wherein said strike member includes a mounting platform that is removably mountable on a seat of said strike carrier, in first and second orientations providing, by virtue of a resulting interface of the mounting platform and the seat, said at least two different strike extension depths.

3. An appliance according to claim 2, wherein said first orientation is rotated 180 degrees with respect to said second orientation.

4. An appliance according to claim 1, wherein said latch mechanism is mounted to the housing cabinet, and said strike member is mountable to said door by way of said strike carrier, which is attached to said door.

5. An appliance according to claim 4, wherein said strike carrier forms a removable frame portion of said door.

6. An appliance according to claim 1, wherein a snap-clip arrangement releasably retains the strike member on said strike carrier in said at least two positions.

7. An appliance according to claim 6, said snap-clip arrangement comprising a spring arm attached to said strike carrier that biases the strike member to effect a releasable engagement of the strike member with said strike carrier, a release of the engagement being effected by a manual press of the strike member against the bias of said spring arm.

8. An appliance according to claim 1, said strike member comprising an elongate metal strike and a strike mounting bracket, said strike being mounted on said mounting bracket for pivoting from side to side about an axis which is orthogonal to a longitudinal axis of said elongate metal strike.

9. An appliance according to claim 1, said strike member comprising an elongated strike and a strike mounting bracket, said strike being movably mounted on said mounting bracket so as to provide a limited amount of play of the strike in the strike extension direction.

10. An appliance according to claim 9, wherein the strike is mounted on the mounting bracket by way of a pin attached to the bracket and which is slidable in a longitudinally extending slot provided in the strike.

11. An appliance according to claim 9, wherein said latch mechanism is a push-to-open, push-to-close (push-push) mechanism.

12. An appliance according to claim 1, wherein said appliance is a front load laundry appliance and said internal compartment is formed by a drum rotatably mounted in said cabinet.

13. An appliance according to claim 12, further comprising a compressible seal member which said door presses against when closed and prior to a latching engagement of said latch and strike member.

14. An appliance according to claim 13, wherein said latch mechanism is a push-to-open, push-to-close (push-push) mechanism that requires said door to compress said seal member in order to effect both latching and unlatching actuations of the mechanism.

15. An appliance according to claim 1, wherein said strike extension depths differ from each other by approximately 1 mm.

16. An appliance, comprising:

a housing cabinet and an interior compartment defined within said housing cabinet, said housing cabinet defining an access opening to provide user access to said interior compartment;

a door mounted to said cabinet so as to be moveable between an open position allowing said user access and a closed position extending over said access opening;

a latch mechanism mounted to one of said housing cabinet and door;

a strike carrier mounted to the other one of said cabinet and door; and a strike member mountable to the other one of said cabinet and door via said strike carrier so as to be engagable with said latch mechanism when said door is in the closed position, to thereby releasably retain the door in the closed position, said strike member being provisioned for removable mounting on said strike carrier in at least a first position providing a first strike extension depth and a second position providing a s second strike extension depth different than the first;

wherein, a snap-clip arrangement releasably retains the strike member on said strike carrier in said first and second positions, said strike member being removable from and replaceable on said strike carrier in said first and second positions via said snap-clip arrangement without removal of the strike carrier from said other one of the cabinet and door.

17. An appliance according to claim 16, said snap-clip arrangement comprising a spring arm attached to said strike carrier that biases the strike member to effect a releasable engagement of the strike member with said strike carrier, a release of the engagement being effected by a manual press of the strike member against the bias of said spring arm.

18. An appliance, comprising:

a housing cabinet and an interior compartment defined within said housing cabinet, said housing cabinet defining an access opening to provide user access to said interior compartment;

a door mounted to said cabinet so as to be moveable between an open position allowing said user access and a closed position extending over said access opening;

a latch mechanism mounted to one of said housing cabinet and door; and a strike member mountable to the other one of said cabinet and door via a strike carrier so as to be engagable with said latch mechanism when said door is in the closed position, to thereby releasably retain the door in the closed position, said strike member being provisioned for mounting on said strike carrier in at least a first position providing a first strike extension depth and a second position providing a second strike extension depth different from the first, said strike member being removeable from and replaceable on said strike carrier in said first and second positions without removal of the strike carrier from said other one of the cabinet and door;

wherein, said strike member comprises an elongate metal strike and a strike mounting bracket, said strike being mounted on said mounting bracket for pivoting from side to side about an axis which is orthogonal to a longitudinal axis of said elongate metal strike.

19. An appliance, comprising:

a housing cabinet and an interior compartment defined within said housing cabinet, said housing cabinet defining an access opening to provide user access to said interior compartment;

a door mounted to said cabinet so as to be moveable between an open position allowing said user access and a closed position extending over said access opening;

a latch mechanism mounted to one of said housing cabinet and door; and a strike member mountable to the other one of said cabinet and door via a strike carrier so as to be engagable with said latch mechanism when said door is in the closed position, to thereby releasably retain the door in the closed position, said strike member being provisioned for mounting on said strike carrier in at least a first position providing a first strike extension depth and a second position providing a second strike extension depth different from the first, said strike member being removeable from and replaceable on said strike carrier in said first and second positions without removal of the strike carrier from said other one of the cabinet and door;

wherein:

said appliance is a front load laundry appliance and said internal compartment is formed by a drum rotatably mounted in said cabinet, said appliance further comprising a compressible seal member which said door presses against when closed and prior to a latching engagement of said latch and strike member; and said latch mechanism is a push-to-open, push-to-close (push-push) mechanism that requires said door to compress said seal member in order to effect both latching and unlatching actuations of the mechanism.

* * * * *